United States Patent [19]

Kohus et al.

[11] Patent Number: 4,822,033

[45] Date of Patent: Apr. 18, 1989

[54] BABY SWING SUPPORT ASSEMBLY

[75] Inventors: Louis M. Kohus; John V. Mariol; David W. Rice, all of Cincinnati, Ohio

[73] Assignee: James F. Mariol, Cincinnati, Ohio

[21] Appl. No.: 116,462

[22] Filed: Nov. 3, 1987

[51] Int. Cl.[4] ..... A63G 9/16

[52] U.S. Cl. ..... 272/86; 297/273

[58] Field of Search ..... 272/85-92; 297/273-282; 5/101-109

[56] References Cited

U.S. PATENT DOCUMENTS

| | | | |
|---|---|---|---|
| 1,189,393 | 7/1916 | Shaw | 297/276 |
| 3,528,657 | 9/1970 | Krupsky | 272/85 |
| 3,806,117 | 4/1974 | Foster | 272/86 |
| 3,842,450 | 10/1974 | Pad | 272/86 X |
| 3,863,981 | 2/1975 | Doyle | 297/278 |
| 4,150,820 | 4/1979 | Bochmann | 272/86 |

FOREIGN PATENT DOCUMENTS

| | | | |
|---|---|---|---|
| 7803250 | 10/1978 | Netherlands | 272/85 |

OTHER PUBLICATIONS

GRACO Swings 4 page Brochure.
Fisher-Price Port-A-Swing 1 page Brochure.
Evenflo Swing/Car Seat/Carrier 1 page Brochure.
Cosco Vista Swing 2 page Brochure.

*Primary Examiner*—David A. Scherbel
*Assistant Examiner*—Richard E. Chilcot, Jr.
*Attorney, Agent, or Firm*—Dressler, Goldsmith, Shore, Sutker & Milnamow, Ltd.

[57] ABSTRACT

A baby swing support structure having a front post construction which, in side elevation, defines a scoop or concave shape to provide ready access to a baby from the sides or front. A stabilizing step at the bottom front of the posts provides a stabilizing means for preventing tipping of the support frame when a baby is to be removed, an important safety feature.

13 Claims, 4 Drawing Sheets

BABY SWING SUPPORT ASSEMBLY

BACKGROUND OF THE INVENTION

The present invention relates to improvements in baby swings, and in particular to a baby swing support structure which provides enhanced stability and improved access to a baby seat suspended from the swing support structure.

A wide variety of baby swings are presently available. Most of them comprise four legs which extend downwardly to form a support structure. In side elevation, the legs are generally straight and typically define a triangle, with the front legs extending downwardly and forwardly and the rear legs extending downwardly and rearwardly. In front elevation, the legs are spaced apart at the top and extend downwardly and slightly outwardly to form a four legged support.

Most of the available swing structures have a cross support at the top joining the two triangles, and the baby swing itself is suspended at its ends on the cross piece. The cross piece or other upper portion of the support structure may mount an electrical or mechanical motor which may be activated to cause the swing to swing forwardly and rearwardly in a gentle fashion.

More recently a snap-together plastic assembly having a U-shaped central structure with a pair of triangular legs, one at each upstanding leg of the U-shaped central structure has been developed. The U-shaped structure is open at the top, the swing is suspended from the U at the tops of the legs of the U-shaped structure and a motor means is provided for swinging the depending seat forwardly and rearwardly.

In virtually all of the current baby swings, side access to the seat is not readily available and the child must be accessed from the front.

It would be of substantial advantage to provide an improved baby swing support structure in which the baby seat may be accessed from the side as well as from the front, and in which the base of the child swing at the front provides stabilizing structure so that when a baby is accessed, the swing support structure does not tend to be tipped.

SUMMARY OF THE INVENTION

In accordance with the present invention, an improved baby swing support structure for providing enhanced stability and access to a baby seat suspended therefrom is provided. The swing support structure comprises a pair of spaced apart upper hubs, a pair of spaced apart support legs, each secured to and extending downwardly and rearwardly from one of the hubs and having a lowermost end which is spaced rearwardly of the hub, and a pair of spaced apart support posts, each secured to and extending downwardly from one of the hubs, each post having a lowermost end which is spaced substantially forwardly of the hub to provide, with said support legs, a stable support for the hubs.

The posts define a forwardly open scoop configuration which may be concave in side elevation to provide ready access to a baby seat suspended from the hubs from the front of the seat and from the sides of the seat without interference by the posts.

The baby swing structure is open at the top, and between the hubs, so that there is ready access to the seat by a person reaching from front to back or back to front to place a baby into the seat or to remove a baby from the seat.

Desirably, the baby swing support structure also includes stabilizing step means for floor support and which is secured to the post lowermost ends. The stabilizing means is positioned to be stepped on as a baby is being removed from the seat.

Each hub may comprise a central upper portion for swingably suspending the seat and a depending portion for securing the upper ends of the legs and posts.

The post means upper ends preferably extend downwardly and rearwardly, and then curve and extend forwardly to the post lowermost end, thereby to provide the forwardly open scoop configuration.

Further features, objects and advantages of the present invention will become apparent from the following drawings and description.

DESCRIPTION OF THE PRESENTLY PREFERRED EMBODIMENT

Figure 1:
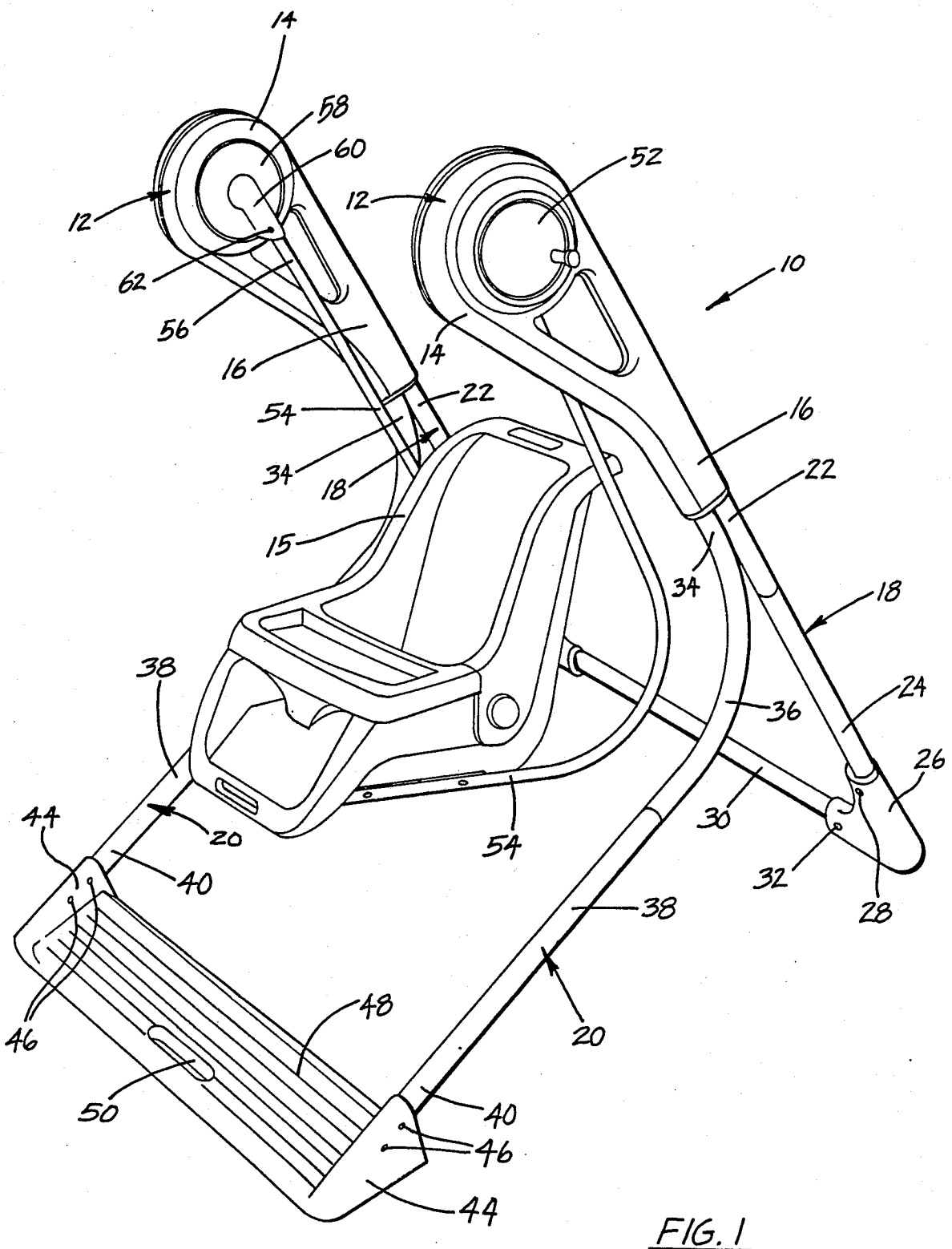
FIG. 1 is a perspective view of a baby swing assembly incorporating the present invention.

Referring now to the drawings which show a baby swing assembly 10 in accordance with the present invention, it is seen to comprise a support structure including a pair of spaced apart upper hubs 12. Hubs 12 define enlarged upper portions 14 which oscillatably suspend the baby seat 15 for swinging movement forwardly and rearwardly. The hubs 12 may be made of plastic and each includes a depending lower portion or sleeve segment 16.

The support structure further includes a pair of spaced apart support legs 18, which may comprise telescoped tubular segments, and which may be generally parallel in front elevation, and further includes a pair of support posts 20. The upper ends 22 of support legs 18 are received and held within the lower portion 16 of hub 12.

Figure 3:
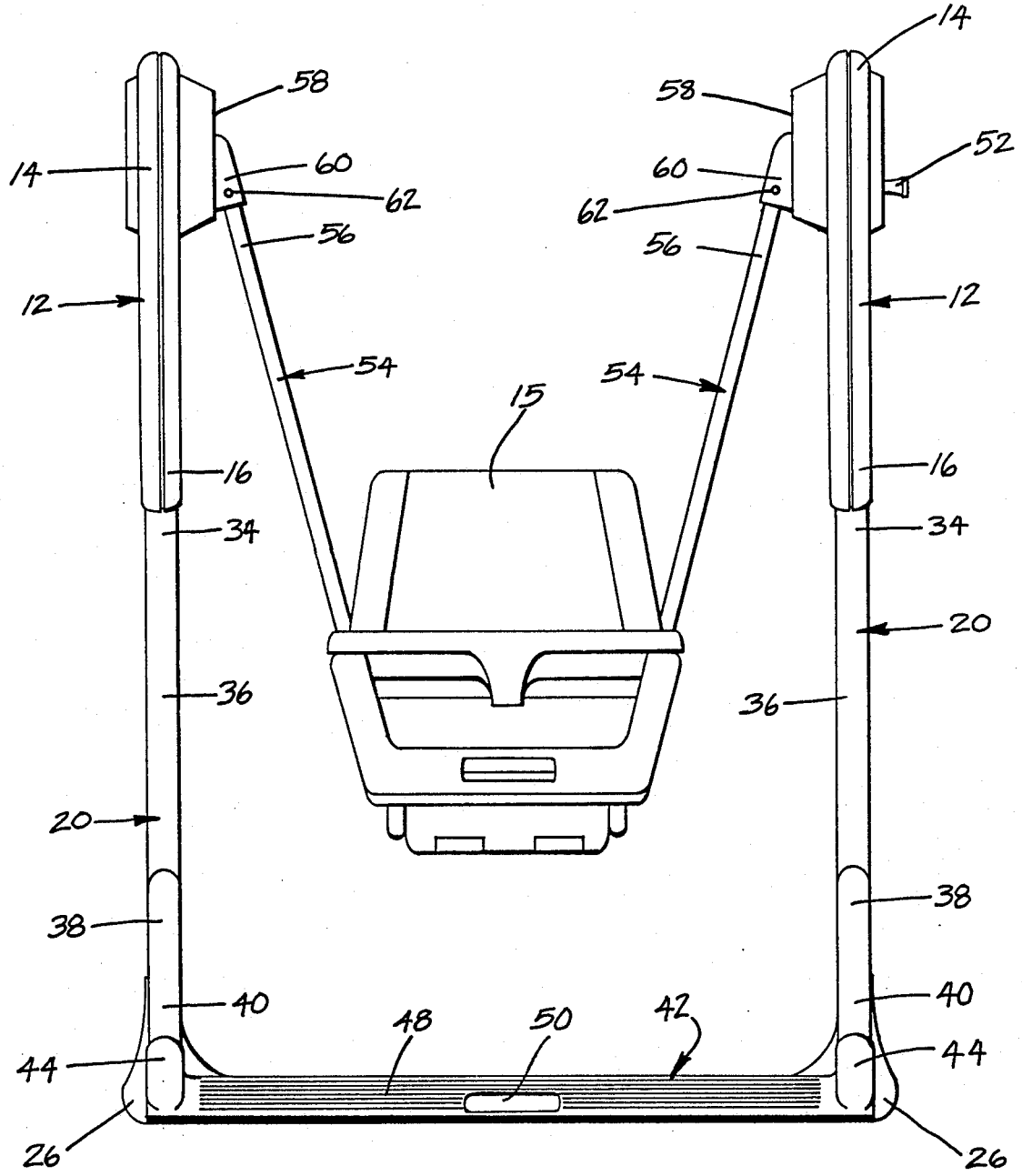
FIG. 3 is a front view of the baby swing assembly of FIG. 1.
Figure 4:
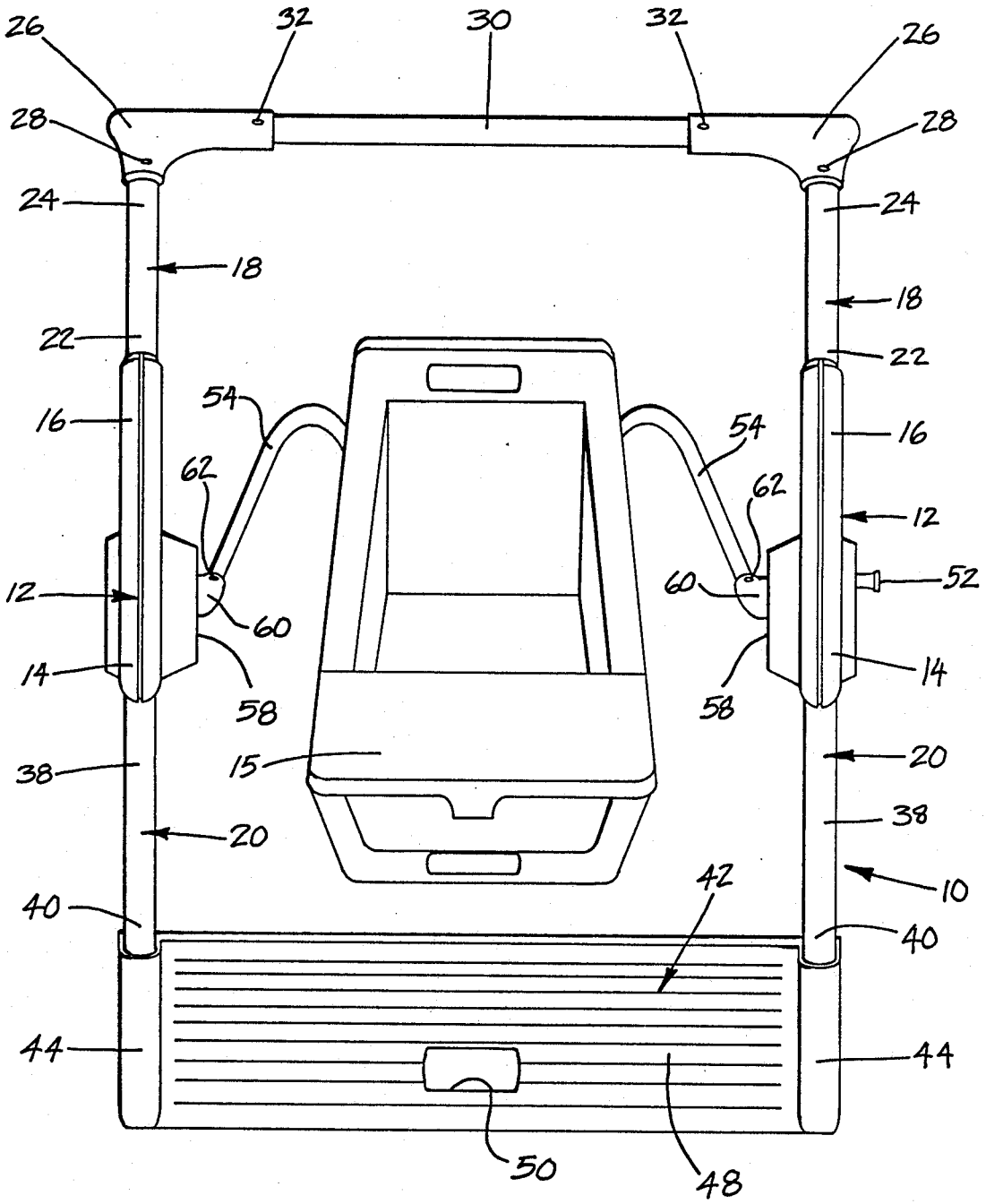
FIG. 4 is a top plan view of the baby swing assembly of FIG. 1.

The lowermost ends of the support legs 18, namely lowermost ends 24, may be received within a plastic fitting 26 and may be secured thereto, as by pins or rivets 28. At their lowermost ends, the support legs 18 are stabilized and joined, as with a cross bar 30, which may be tubular, and which may be joined with and secured to the fitting 26, as by pins or rivets 32. Alternatively, legs 18 and cross bar 30 may comprise a U-shaped tubular construction without a connecting fitting 26. Whether the leg-cross bar 30 construction is tubular or with a fitting, it is desirable to square off the lower ends for stabilization purposes as best seen in FIGS. 3 and 4.

Thus, the portion of the support structure incorporating support legs 18 may be seen to be generally U-shaped in configuration with the free upper ends 22 captured within, and secured to, the sleeve-like lower portion 16 of hub 12.

Figure 2:
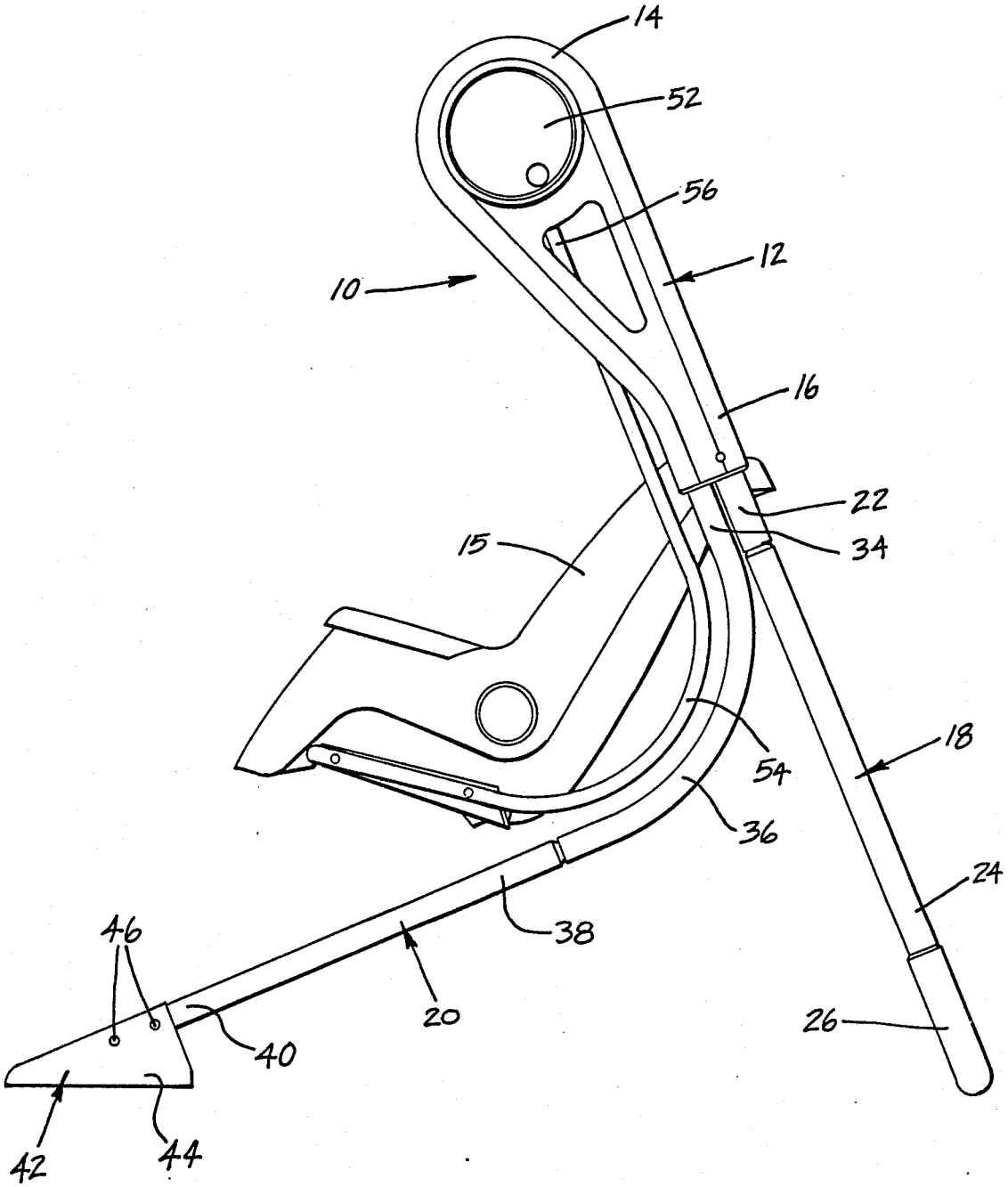
FIG. 2 is a side elevational view of the baby swing assembly of FIG. 1.

The support structure further includes the support posts 20. Support posts 20 have upper ends 34 which, like upper ends 22, are retained within the sleeve-like lower portions 16 of hubs 12. These post ends 34, as best seen in FIGS. 1 and 2, extend downwardly and rearwardly, then curve forwardly at post segment 36, and then extend forwardly at post section 38. The support posts 20 may be tubular and may be segmental, joined telescoping portions. Support posts 20 may be generally parallel when viewed in front elevation. Also, when viewed in front elevation the legs and posts are preferably aligned.

The lowermost ends 40 of the support posts 20 may be associated with a stabilizing means which join them together. In the preferred embodiment, the stabilizing means comprises a step means which defines side segments 44 which receive the lowermost ends 40 and which are secured thereto as by pins or rivets 46.

The step means may provide ridges, knurling or roughening on the upper surface of central section 48, to prevent movement of the swing support structure when a person's foot is placed thereon. Also, a hand grip slot 50 may be provided in the central section 48 to facilitate gripping of the swing assembly for movement of same from one location to another.

The support structure, as stated, is provided with a motor means 52 mounted on the hub, which may be a mechanical or electrical motor known to the art.

The baby seat 15 is fixedly secured to support arms 54. Support arms 54 may be generally scoop shaped, as may be seen in FIGS. 1 and 2, so that access to the child from the front and from the sides is unimpeded. The lower ends of the support arms 54 are appropriately secured to the seat in a known manner, and the upper ends 56 of the support arms 54 are secured to suitable bearing assemblies 58, via sleeves 60 secured to the bearing assemblies 58, again as by pins or rivets 62.

As best seen in FIG. 2, the support posts 20 are deeply concave in side elevation, i.e., may be said to define a forwardly open scoop configuration. Thus, they permit and provide ready access to the seat 15 and to the baby from the sides of the support structure, as well as from the front without interference by the posts. Of course, the concave configuration may be curved as illustrated, or the concave configuration may be generally L-shaped to provide the same open access from the sides.

When access to the seat and/or baby from the front is desired, the stabilizing step 42 joining the lowermost ends of the posts, and which is floor supported, is adapted to be stepped on so that as the baby is removed from the seat, the anchoring provided by the foot resists tilting, such as by pulling of the entire swing assembly forwardly. This is an important safety feature.

It is also to be noted that the swing structure 10 of the present invention is open at the top, between the hubs 12, so that as a person is placing a baby in the swing seat 15 reaches forwardly to place the baby in the seat or to remove the child from the seat, there is no interference by or contact with a cross piece as is typically a problem with many available baby swing support structures.

The baby swing support structure of the present invention is relatively simple to manufacture and assemble. It provides enhanced stability and improved access to the baby seat and may be constructed so that it is overall lower to the ground without otherwise detracting from its full-featured character.

It will be apparent to those skilled in the art that modifications and variations may be made in the swing seat, the preferred embodiment of which is shown, described and illustrated herein. Accordingly, the invention is not to be considered as being limited to the specific embodiment, but instead is to be considered in the context of the appended claims.

What is claimed:

1. A baby swing support structure for providing enhanced stability and improved access to a baby seat comprising:

a pair of spaced apart upper hubs, a pair of spaced apart support legs, each having an upper end, and each said leg extending downwardly and rearwardly from one of said hubs and having a lowermost end which is spaced rearwardly of the hub, a pair of spaced apart support posts, each having an upper end, each said post secured to and extending downwardly from its upper end from one of said hubs, each said post having a lowermost end which is spaced substantially forwardly of the hub to provide, with said support legs, a stable support for the hubs, and wherein one of said posts is generally aligned in front elevation with one of said legs and the other of said posts is generally aligned in front elevation with the other of said legs, a baby seat suspended from said hubs, wherein said posts are concave in side elevation to provide ready access to said seat without interference by said posts, and wherein said structure has a top and is open at the top, and between said hubs, to provide ready access to said seat by a person reaching forwardly to place a baby into said seat or to remove a baby from said seat.

2. The baby swing support structure of claim 1, and further comprising a stabilizing means joining said post lowermost ends adjacent said post lowermost ends.

3. The baby swing support structure in accordance with claim 2, and wherein said stabilizing means comprises step means adapted for floor support and positioned to be stepped on as a baby is removed from said seat.

4. The baby swing support structure in accordance with claim 1, and wherein said hub mounts motor means for swinging said seat.

5. The baby swing support structure in accordance with claim 1, and wherein each said hub comprises a central upper portion for swingably suspending said seat and a depending portion for securing the upper ends of said legs and posts.

6. The baby swing support structure in accordance with claim 1, and wherein the upper ends of said post means extend downwardly and rearwardly, and then curve and extend forwardly to said post lowermost ends to define said concave configuration.

7. The baby swing support structure in accordance with claim 6, and wherein said leg lowermost ends are joined with a cross bar.

8. The baby swing support structure in accordance with claim 7, and further including step means adapted for floor support joining said post lowermost ends and said step means being positioned to be stepped on as a baby is removed from said seat.

9. The baby swing support structure in accordance with claim 1, and wherein the seat is suspended directly from the hubs, and wherein there is no cross piece connecting the hubs.

10. A baby swing support structure for providing enhanced stability and access to a baby seat suspended therefrom comprising:

a pair of spaced apart upper hubs, a pair of spaced apart support legs, each secured to and extending downwardly and rearwardly from one of said hubs and having a lowermost end which is spaced rearwardly of the hub, a pair of generally parallel spaced apart support posts, each secured to and extending downwardly from one of said hubs, each said post having a lowermost end which is spaced substantially forwardly of the hub to provide, with said support legs, a stable support for the hubs, said posts defining a forwardly open scoop configuration in side elevation to provide ready access to a baby seat suspended from said hubs from the front of said seat and from the sides of said seat without interference by said posts, said structure having a top and being open at the top, and between said hubs, to provide ready access to said seat by a person reaching forward to place a baby into said seat or to remove a baby from said seat.

11. The baby swing support structure in accordance with claim 10, and further comprising stabilizing step means secured to said post lowermost ends for floor support, and positioned to be stepped on as a baby is being removed from said seat.

12. The baby swing support structure in accordance with claim 11, and wherein each said hub comprises a central upper portion for swingably suspending said seat and a depending portion for securing, the upper ends of said legs and posts.

13. The baby swing support structure in accordance with claim 10, and wherein the upper ends of said post means extend downwardly and rearwardly, and then curve and extend forwardly to said post lowermost ends, thereby to provide said forwardly open scoop configuration.

* * * * *